US005155297A

United States Patent [19]

Lindstadt et al.

[11] Patent Number: 5,155,297

[45] Date of Patent: Oct. 13, 1992

[54] PROJECTILE-FORMING EXPLOSIVE CHARGE INSERT

[75] Inventors: Klaus Lindstadt, Schwaig; Reinhard Pötzl, Nuremberg; Karl Rudolf, Schrobenhausen, all of Fed. Rep. of Germany

[73] Assignee: Diehl GmbH & Co., Nuremberg, Fed. Rep. of Germany

[21] Appl. No.: 788,542

[22] Filed: Jul. 9, 1985

[30] Foreign Application Priority Data

Jul. 21, 1984 [DE] Fed. Rep. of Germany ..... 3426847

[51] Int. Cl.[5] ..... F42B 10/00; F42B 12/00; F42B 12/10

[52] U.S. Cl. ..... 102/476; 102/306; 102/501

[58] Field of Search ..... 102/214, 305-310, 102/475, 476, 501

[56] References Cited

U.S. PATENT DOCUMENTS

| | | | |
|---|---|---|---|
| 3,146,711 | 9/1964 | Schaadt et al. | 102/476 X |
| 4,080,898 | 3/1978 | Gieske | 102/306 |
| 4,499,830 | 2/1985 | Majerus et al. | 102/476 |
| 4,584,943 | 4/1986 | Vavra et al. | 102/214 |

*Primary Examiner*—Harold J. Tudor
*Attorney, Agent, or Firm*—Scully, Scott, Murphy & Presser

[57] ABSTRACT

A projectile-forming explosive charge-insert of intensified penetrating power into a target, wherein a mass or weight component is centrally positioned in the insert, and the weight member possesses at least one shank projecting into the explosive charge. The weight member or mass serves as a stabilizer during the deformation of the insert into a projectile. The deformation procedure is favorably influenced by the weight member; in effect, during the collaboration of the insert in the region of the head, the mass or weight member acts in a damping or attenuating manner. Governing for the attenuating property of the weight member is, accordingly, its length towards the explosive and its attenuating capacity specific to its material.

9 Claims, 3 Drawing Sheets

PROJECTILE-FORMING EXPLOSIVE CHARGE INSERT

BACKGROUND OF THE INVENTION

1. Field of the Invention

The present invention relates to a projectile-forming explosive charge-insert.

2. Discussion of the Prior Art

For instance, an insert of that type is known from the disclosure of German Published Patent Application 19 10 779, referring particularly to FIG. 2. As a result of the energy which is released during the detonation of an explosive charge, the insert is deformed into a compact projectile which will strike against a target at high velocity, and penetrates through the target.

SUMMARY OF THE INVENTION

Accordingly, it is an object of the present invention, commencing from the state of the art represented by the disclosure of German AS 19 10 779, to contemplate the provision of an insert which possesses an intensified level of penetrating power.

The foregoing object is achieved through the intermediary of a projectile-forming explosive charge-insert of the above-mentioned type, wherein a mass or weight component is centrally positioned in the insert, and the weight member possesses at least one shank projecting into the explosive charge.

It is of importance to the invention that because of the weight member, the ratio of the length l relative to the diameter d of the projectile is to be increased through the stretching of the latter. In the critical region of the projectile intermediate the tail end and the head end thereof, there are encountered small fissures. Consequently, there is achieved in a projectile of this type, that is can be stretched more extensively by 10 to 60% than in a projectile of comparable weight pursuant to that of DE AS 19 10 779. The inventive ratio of l/d consists of a maximum of 3.5 to 4 in dependence upon the geometry of the insert, the insert mass, insert material, and the explosive. Due to this l/d ratio there is attained an intensified penetrating power. Governing for this penetrating power are the smaller cross-sections of the projectile exposed to the oncoming airflow during flight and the smaller pressure surface in the target.

The smaller cross-sections exposed to the oncoming airflow produces only a small reduction in the velocity at projectile flying ranges of about 120 m. The smaller pressure surface leads to a correspondingly higher specific surface loading in the target. Geometrically determinant for the pressure surface is the size of the radius of the projectile in cross-section with the main axis.

The weight member or mass serves as a stabilizer during the deformation of the insert into a projectile. The deformation procedure is favorably y the weight member; in effect, during the collaboration of the insert in the region of the head, the mass or weight member acts in a damping or attenuating manner. Governing for the attenuating property of the weight member is, accordingly, its length towards the explosive and its attenuating capability or property which is specific to its material.

The damping or attenuating effect of the weight member also is present during the existence of the projectile up to the point of striking the target,. in that, longitudinal vibrations which are generated within the projectile are dampened to such an extent, that the projectile will not be torn apart.

At a suitable material selection for the weight member, such as relatively heavy material, the sweep or arcing stabilization of the projectile can be positively enhanced through exerting an influence over the center, of gravity of the weight member in a direction towards an improved flight stability at distances to the target of about 20 to 120 m which are usual for P-charges. This will then also significantly increase the penetrating power and the effect of the projectile behind the armoring of the target.

Further advantages and modifications of the invention may now be ascertained from the following detailed description as set forth hereinbelow pertaining to preferred embodiments of the mass or weight member, with regard to geometric parameters, as well as material specifications and material pairings between the weight member and the insert.

BRIEF DESCRIPTION OF THE DRAWINGS

Reference may now be had to the following exemplary embodiments of the invention, taken in conjunction with the accompanying drawings; in which.

DETAILED DESCRIPTION

Figure 1:
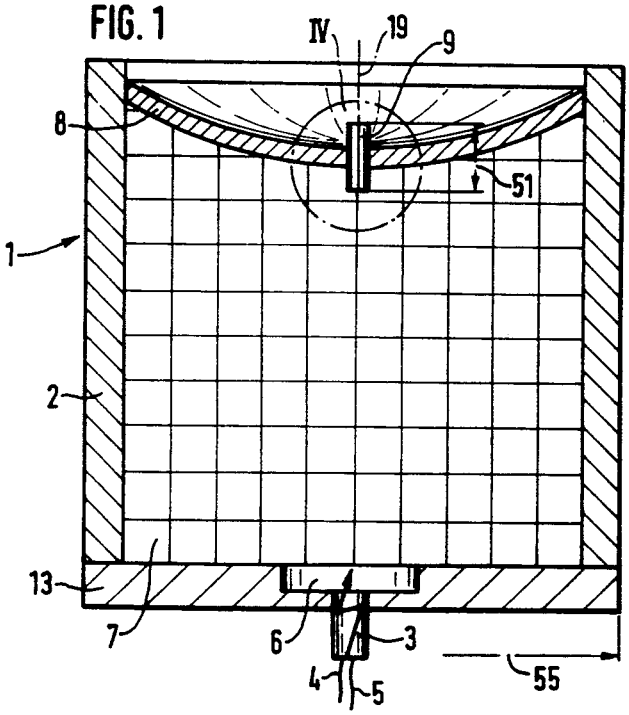
FIG. 1 illustrates a transverse sectional view through a projectile-forming charge.

A projectile-forming charge 1 includes a casing or housing 2 with a detonator 3, with cables 4, 5, an intensifying charge 6, explosive 7, insert 8, and a weight member 9. A housing base is identified by reference numeral 13.

Figure 2:
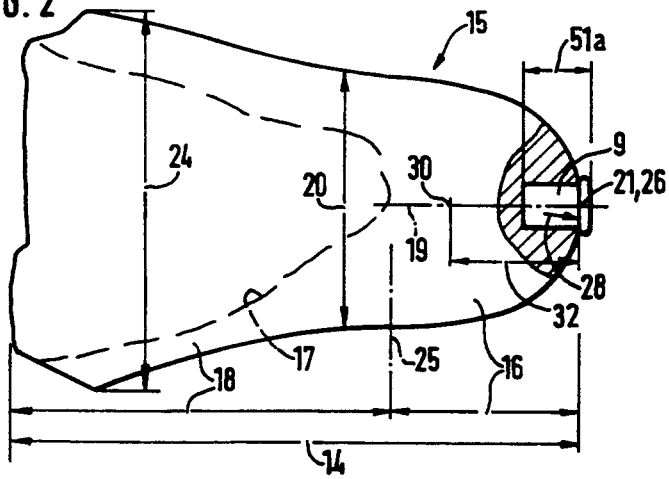
FIG. 2 illustrates a projectile produced by the charge of FIG. 1.

In accordance with FIG. 2, a projectile 15 which is formed by the charge 1 consists of a head portion 16 and a tail portion 18 which possesses a hollow space 17. Within the head portion, a weight member 9 is located along the main axis 19, which is somewhat compressed with respect to its length 51*a* and deformed at its end.

The diameter of the projectile d is identified by reference numeral 20 and its length 1 by reference numeral 14. The ratio of l/d in the herein illustrated example consists of 2.1.

Figure 3:
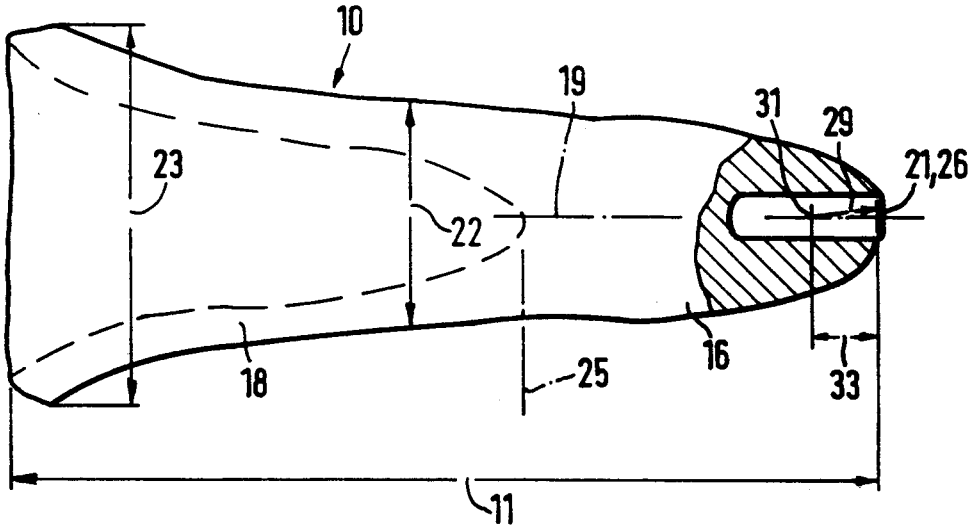
FIG. 3 illustrates a further embodiment of a projectile.

Pursuant to FIG. 3, in a projectile 10 the ratio of the length 11 to the diameter 22 = 3.75.

In the projectiles 10 and 15, more weight or mass is concentrated along the main axis 19 than in the projectile according to German AS 19 10 779.

Moreover, the aerodynamically governing cross-sections or diameters 20 through 24 at the end surface facing the oncoming airflow, as well as the pressure surfaces 26 in the target (the weight member 9 can hereby be neglected) which are essentially decisive to the penetrating effect, are hereby smaller. The forward cross-sections 21 facing the oncoming airflow are identical with the pressure surfaces 26. They are geometrically defined by the radii 28, 29 at the point of intersection 21, 26 with the applicable main axis 19. The centers of the radii 28, 29 on the main axis 19 are identified by reference numerals 30, 31, and their distances from the above-mentioned intersecting points by 32, 33.

This will afford that the projectile 10 or respectively 15, especially in the critical region between the head portion 16 and the tail portion 18 identified by 25, will not form tears or be even completely torn apart.

Figure 4:
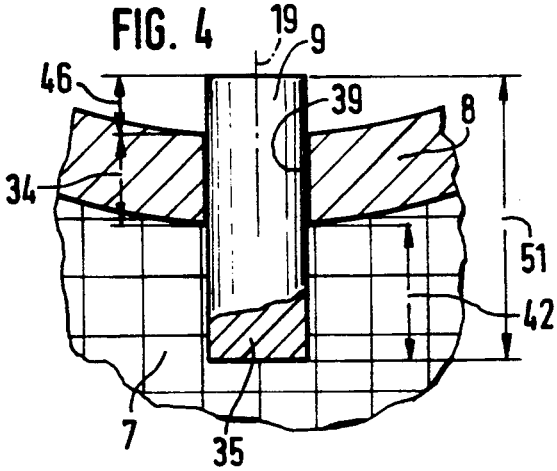
FIG. 4 illustrates, on an enlarged scale, a fragmentary section within the encircled portion IV in FIG. 1.

In accordance with FIG. 4, the weight member 9 is adhesively fastened within, a bore 31 in the insert 8. The length thereof extending into the explosive is identified by reference numeral 42 its length projecting from the insert 8 towards the target by reference numeral 46. The total overall length 51 of the weight member 9 is hereby obtained from combining the thickness 34 of the insert 8 and from the lengths 42 and 46. The weight member 9 possesses a solid cross-section 35 and is constituted of brass.

In conformance with FIGS. 5 through 9 there is presently provided the insert 8, which is drawn in phantom-lines. The difference is merely the configuration of the weight members 36, 40, 43, 47, and 48, which each possess a shank portion 44, 45.

Figure 5:
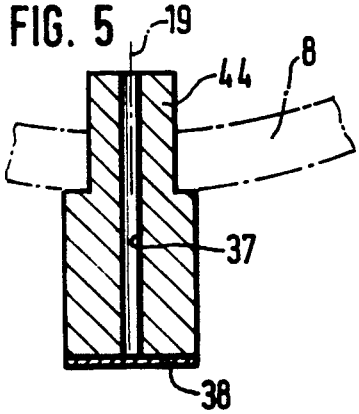
FIG. 5 through 9 disclose, respectively, various embodiments of the weight member.

Pursuant to the embodiment of FIG. 5, the weight member 36 is provided with a through-bore 37, as well as with a plate 38 adhesively fastened thereto. The plate 38 prevents the penetration of the explosive into the bore 37.

Figure 6:
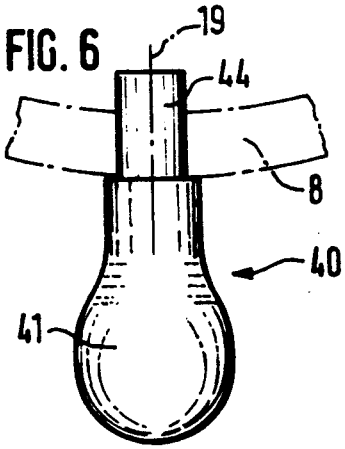
Figure 7:
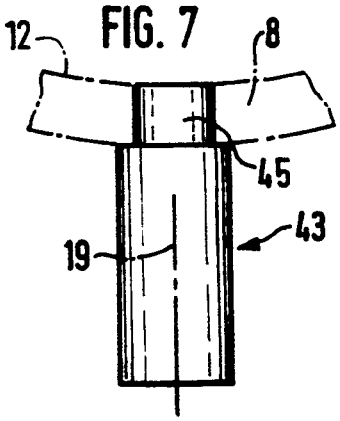

In accordance with FIG. 6, the weight member 40 has a droplet-shaped configuration 41 facing towards the explosive. Pursuant to FIG. 7, the shank portion 45 is closely fitted to the inner surface 27 of the insert 8.

Figure 8:
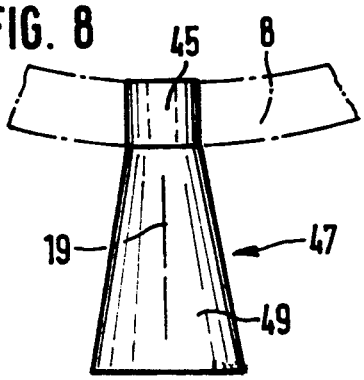
Figure 9:
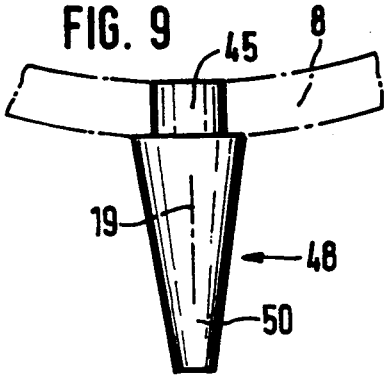

In accordance with FIGS. 8 and 9, the weight members 47, 48 are each provided with flat-conical shank portions 49, 50.

Pursuant to preferred parameters of the invention:

(1) The mass of the weight member is about 0.3% to 0.6% relative to the mass of the insert.

(2) The weight member is constituted of a relatively heavy material selected from the group consisting of copper, brass, tantalum; and wherein the insert is selected from the group of materials consisting of soft iron, mild steel, copper, tantalum or from a heavy metal (3) The length of the shank portion facing towards the explosive charge is about 15 to 20% that of the caliber of the formed projectile, and the diameter at the middle of the length thereof about 1.5 to 5% or the caliber of the formed projectile.

(4) The weight member is either adhesively fastened into, press-fitted into or screwed into an aperture in the insert.

What is claimed is:

1. In an arrangement for explosively deforming an insert into a projectile fired against a target, including a housing having a base incorporating a detonator; a substantially disc-shaped insert in said housing spaced from said base, the space between said base and said insert being filled with an explosive charge; the improvement comprising in that an elongate rotationally-symmetrical weight member which is solid in cross-section extends centrally through said insert at a normal orientation relative thereto and includes at least one shank portion projecting into said explosive charge, a portion of the weight member extending through the insert to project a distance towards the target, said distance being about 15% of the length of the shank portion projecting into the explosive charge, the length of the shank portion projecting into the explosive charge being about 15 to 20% of the caliber of the projectile formed by said insert and the diameter of said shank along about the middle of its length being about 1.5% to 5% the caliber of said projectile, the weight member being constituted of a relatively heavy material selected from the group consisting of copper, brass, tantalum; and the insert being selected from the group of materials consisting of soft iron mild steel, copper, tantalum, or a heavy metal alloy.

2. A projectile-forming arrangement as claimed in claim 1, wherein the mass of the weight member is about 0.3% to 0.6% the mass of the insert.

3. A projectile-forming arrangement as claimed in claim 1, wherein the weight member extends through a central aperture of said insert.

4. A projectile-forming arrangement as claimed in claim 3, wherein said weight member is adhesively fastened to said insert.

5. A projectile-forming arrangement as claimed in claim 3, wherein said weight member is in press-fitted engagement with the aperture in said insert.

6. A projectile-forming arrangement as claimed in claim 3, wherein said weight member is screwed into said aperture of the insert.

7. A projectile-forming arrangement as claimed in claim 1, wherein the rotationally-symmetrical configuration of said weight member extends about a main axis extending towards the explosive.

8. A projectile-forming arrangement as claimed in claim 7, wherein said shank portion is rod-shaped.

9. A projectile-forming arrangement as claimed in claim 7, wherein said shank portion is cylindrical.

* * * * *

UNITED STATES PATENT AND TRADEMARK OFFICE

CERTIFICATE OF CORRECTION

PATENT NO. : 5,155,297

DATED : October 13, 1992

INVENTOR(S) : Klaus Lindstadt, et al.

It is certified that error appears in the above-identified patent and that said Letters Patent is hereby corrected as shown below:

Column 1, line 38: "is" should read as --it--

Column 1, line 57: "favorably y" should read as --favorably influenced by--

Column 1, line 67: "target,." should read as --target,--

Column 3, line 10: "42 its" should read as --42 and its--

Column 3, line 42: after "metal" insert --alloy--

Signed and Sealed this

Fourteenth Day of December, 1993

Bruce Lehman

*Attest:*

BRUCE LEHMAN

*Attesting Officer*

*Commissioner of Patents and Trademarks*